US009538594B2

(12) United States Patent
Chen et al.

(10) Patent No.: US 9,538,594 B2
(45) Date of Patent: Jan. 3, 2017

(54) LAMP

(71) Applicant: LEXTAR ELECTRONICS CORPORATION, Hsinchu (TW)

(72) Inventors: Chun-Kuang Chen, Taipei (TW); Chien-Nan Yeh, Kaohsiung (TW)

(73) Assignee: LEXTAR ELECTRONICS CORPORATION, Hsinchu (TW)

( * ) Notice: Subject to any disclaimer, the term of this patent is extended or adjusted under 35 U.S.C. 154(b) by 193 days.

(21) Appl. No.: 13/901,923

(22) Filed: May 24, 2013

(65) Prior Publication Data

US 2014/0103824 A1 Apr. 17, 2014

(30) Foreign Application Priority Data

Oct. 11, 2012 (TW) ..... 101137483 A

(51) Int. Cl.

| | |
|---|---|
| ***H05B 37/00*** | (2006.01) |
| ***H05B 39/00*** | (2006.01) |
| ***H05B 41/00*** | (2006.01) |
| ***H05B 33/08*** | (2006.01) |
| ***F21V 23/00*** | (2015.01) |
| *F21Y 101/00* | (2016.01) |

(52) U.S. Cl.

CPC ..... *H05B 33/0821* (2013.01); *F21K 9/20* (2016.08); *F21V 23/005* (2013.01); *H05B 33/0803* (2013.01); *F21Y 2101/00* (2013.01)

(58) Field of Classification Search

CPC ..... H05B 33/0821
USPC ..... 315/192
See application file for complete search history.

(56) References Cited

U.S. PATENT DOCUMENTS

| | | | | |
|---|---|---|---|---|
| 8,092,043 | B2 * | 1/2012 | Lin | F21K 9/00 362/221 |
| 8,686,641 | B2 * | 4/2014 | Maxik | F21K 9/13 315/113 |
| 8,887,384 | B2 * | 11/2014 | Kasper | H05K 1/02 257/433 |
| 2008/0265781 | A1 * | 10/2008 | Lin | F21K 9/00 315/113 |
| 2010/0124054 | A1 * | 5/2010 | Chen | F21K 9/00 362/221 |
| 2010/0201269 | A1 * | 8/2010 | Tzou | F21K 9/175 315/51 |

(Continued)

FOREIGN PATENT DOCUMENTS

| | | |
|---|---|---|
| CN | 201462492 U | 5/2010 |
| CN | 201555060 U | 8/2010 |

(Continued)

*Primary Examiner* — Lincoln Donovan
*Assistant Examiner* — Metasebia Retebo
(74) *Attorney, Agent, or Firm* — Moser Taboada

(57) ABSTRACT

A lamp includes a lamp tube, a carrier, a light bar circuit board, a driver circuit board, a plurality of first luminous elements and a parallel-connected type luminous unit. The carrier is accommodated in the lamp tube. The light bar circuit board is disposed on the carrier. The driver circuit board is disposed on the carrier and adjoins the light bar circuit board. The first luminous elements are disposed on the light bar circuit board. The parallel-connected type luminous unit is disposed on the driver circuit board, and includes a plurality of luminous element groups connected in parallel.

10 Claims, 4 Drawing Sheets

(56) References Cited

U.S. PATENT DOCUMENTS

| | | | | |
|---|---|---|---|---|
| 2010/0220476 | A1* | 9/2010 | Kuo | F21K 9/00 362/235 |
| 2011/0058365 | A1* | 3/2011 | Osawa | F21V 23/00 362/217.01 |
| 2011/0169415 | A1 | 7/2011 | Chen et al. | |
| 2012/0002408 | A1* | 1/2012 | Lichten | F21S 8/063 362/218 |
| 2012/0043884 | A1* | 2/2012 | Lee | F21K 9/17 315/32 |
| 2013/0050998 | A1* | 2/2013 | Chu | F21K 9/17 362/218 |
| 2013/0057165 | A1* | 3/2013 | Ide | H05B 33/0845 315/186 |
| 2013/0076254 | A1* | 3/2013 | Tsai | H05B 33/0818 315/192 |
| 2013/0127338 | A1* | 5/2013 | Lee | F21K 9/175 315/52 |
| 2015/0061542 | A1* | 3/2015 | Hsia | F21V 25/04 315/294 |

FOREIGN PATENT DOCUMENTS

| | | | |
|---|---|---|---|
| CN | 201657388 | U | 11/2010 |
| CN | 201731347 | | 2/2011 |
| CN | 102434857 | A | 5/2012 |
| JP | 2009527073 | A | 7/2009 |
| TW | M414545 | U | 10/2011 |
| TW | 201206242 | A | 2/2012 |
| TW | M430002 | U | 5/2012 |
| TW | M433504 | U | 7/2012 |

* cited by examiner

LAMP

RELATED APPLICATIONS

This application claims priority to Taiwan Application Serial Number 101137483, filed Oct. 11, 2012, which is herein incorporated by reference.

BACKGROUND

Technical Field

Embodiments of the present invention relate to a luminous device. More particularly, embodiments of the present invention relate to a lamp.

Description of Related Art

Because the light emitting diode (LED) is of low power-consumption and high efficient, it has been widely used in the backlight module and the illumination device. In recent years, the LED lamp has been quickly replacing the conventional incandescent light bulbs and fluorescent lamps.

A typical LED lamp includes a light transmissive tube, a light bar, a carrier and a driver. The light bar is placed on the carrier. The carrier is inserted into the chamber in the light transmissive tube through the lateral opening of the tube. The driver is accommodated in the carrier. Because the size of the LED is made smaller and smaller, the small-sized LEDs disposed on the light bar exhibit as spot-like light rather than uniform light.

To address this issue, the light bar was arranged closer to the bottom surface of the light transmissive tube to increase the distance between the top surface of the light transmissive tube and the LED on the light bar, such that the emitted light of the tube became more uniform.

However, arranging the light bar closer to the bottom surface of the light transmissive tube should significantly reduce the thickness of the carrier. As such, the driver can no longer be accommodated in the carrier. Instead, the driver is disposed at the end of the light transmissive tube, which makes the end of the tube dark and visually deteriorates the value of the LED lamp.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

In accordance with one embodiment of the present invention, a lamp includes a lamp tube, a carrier, a light bar circuit board, a driver circuit board, a plurality of first luminous elements and a parallel-connected type luminous unit. The carrier is accommodated in the lamp tube. The light bar circuit board is disposed on the carrier. The driver circuit board is disposed on the carrier and adjoins the light bar circuit board. The first luminous elements are disposed on the light bar circuit board. The parallel-connected type luminous unit is disposed on the driver circuit board, and includes a plurality of luminous element groups connected in parallel.

It is to be understood that both the foregoing general description and the following detailed description are by examples, and are intended to provide further explanation of the invention as claimed.

BRIEF DESCRIPTION OF THE DRAWINGS

The invention can be more fully understood by reading the following detailed description of the embodiment, with reference made to the accompanying drawings as follows.

DETAILED DESCRIPTION

Figure 1:
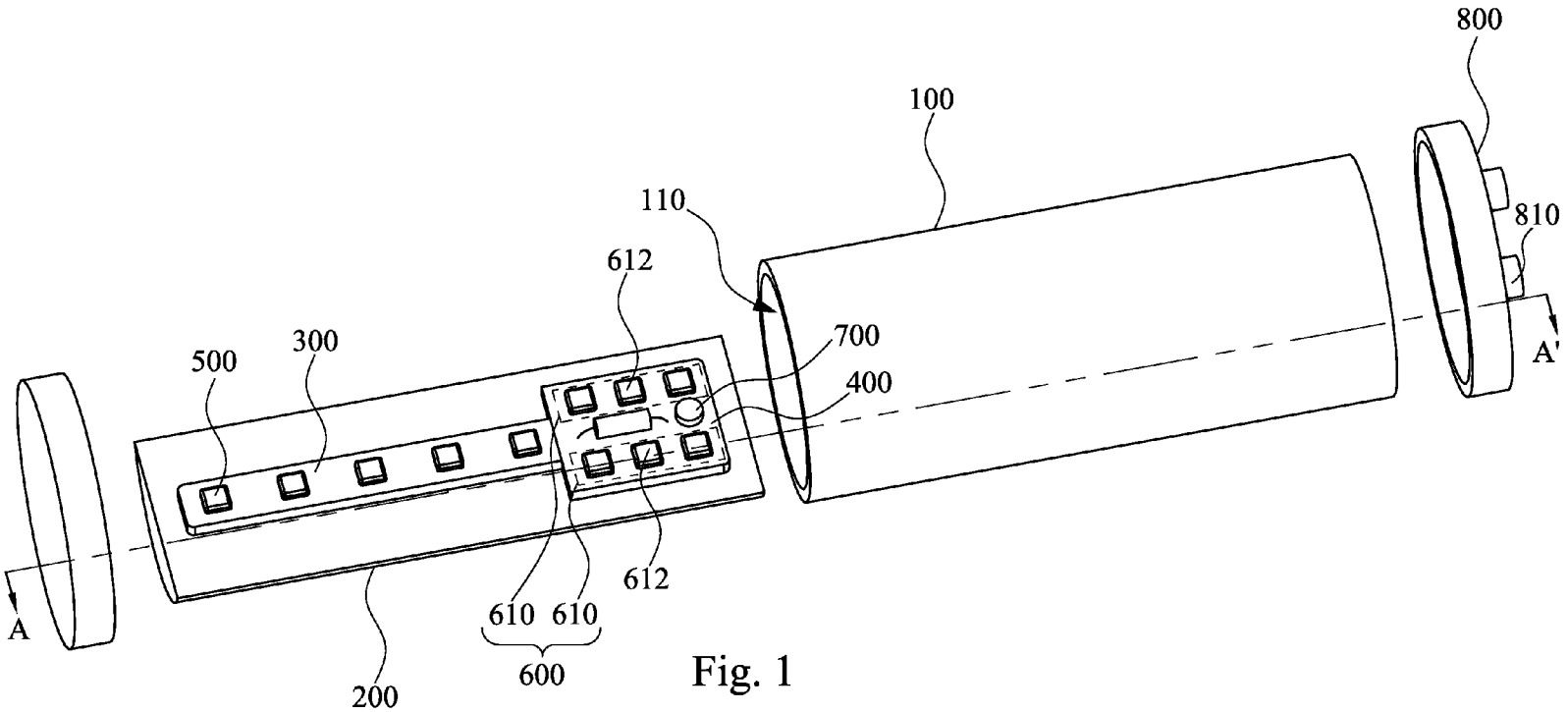
FIG. 1 is an explosive view of the lamp in accordance with one embodiment of the present invention.

Reference will now be made in detail to the present embodiments of the invention, examples of which are illustrated in the accompanying drawings. Wherever possible, the same reference numbers are used in the drawings and the description to refer to the same or like parts.

FIG. 1 is an explosive view of the lamp in accordance with one embodiment of the present invention. As shown in FIG. 1, the lamp includes a lamp tube 100, a carrier 200, a light bar circuit board 300, a driver circuit board 400, a plurality of first luminous elements 500 and a parallel-connected type luminous unit 600. The carrier 200 is accommodated in the lamp tube 100. The light bar circuit board 300 is disposed on the carrier 200. The driver circuit board 400 is disposed on the carrier 200 and adjoins the light bar circuit board 300. The first luminous elements 500 are disposed on the light bar circuit board 300. The parallel-connected type luminous unit 600 is disposed on the driver circuit board 400.

Because the parallel-connected type luminous unit 600 disposed on the driver circuit board 400 is able to emit light, even though the driver circuit board 400 is positioned on the end of the lamp tube 100, the end of the lamp tube 100 will not be dark.

Figure 2:
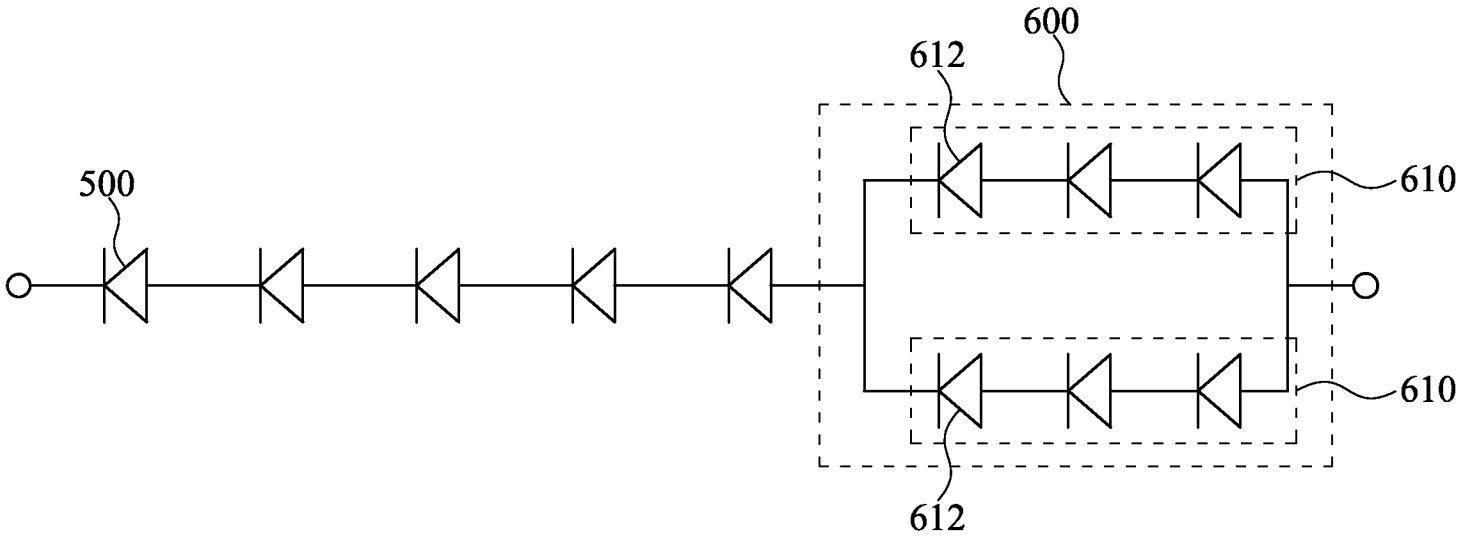
FIG. 2 is an equivalent circuit diagram of the first luminous elements and the parallel-connected type luminous unit.

FIG. 2 is an equivalent circuit diagram of the first luminous elements 500 and the parallel-connected type luminous unit 600. In this embodiment, the parallel-connected type luminous unit 600 includes a plurality of luminous element groups 610. The luminous element groups 610 are connected to each other in parallel, so the current which flows through each luminous element group 610 can be lowered, thereby reducing the generated heat and preventing the degradation of the light output from the luminous element group 610 owning to overheat or preventing from influencing the work of the electric devices on the driver circuit board 400.

In some embodiments, the first luminous elements 500 are connected to the parallel-connected type luminous unit 600 in series. In other words, the parallel-connected type luminous unit 600 and the first luminous elements 500 are connected in one loop, so that they can share one power supply without requiring an additional power supply. Further, the first luminous elements 500 can connect in series or in parallel and disposed on the light bar circuit board 300.

In some embodiments, each of the luminous element groups 610 includes a plurality of second luminous elements 612. Because a plurality of luminous element groups 610 are connected in parallel, in comparison to a single luminous element group 610, the total number of the second luminous elements 612 can be increased by means of luminous element groups 610 connected in parallel. Thus the second luminous elements 612 can be more uniformly distributed on the driver circuit board 400, and the light on the driver circuit board 400 can be more uniform.

Specifically, a single second luminous element 612 can be replaced by two parallel-connected second luminous elements 612. When the number of the luminous element group 610 increases, a single second luminous element 612 can be replaced by more parallel-connected second luminous elements 612. For example, when the number of the luminous element group 610 is N, a single second luminous element 612 can be replaced by N second luminous elements 612, and these N second luminous elements 612 are respectively included in N luminous element groups 610. N is a positive integer greater than 2.

Because the first luminous elements 500 are connected to the parallel-connected type luminous unit 600 in series, the total current flowing through the parallel-connected type luminous units 600 is equal to the current flowing through the first luminous elements 500. Further, because the voltage of the parallel-connected type luminous unit 600 is equal to the voltage of each luminous element groups 610. Therefore, the number of the luminous element groups 610 can be increased when the total current and the voltage of the parallel-connected type luminous unit 600 is constant, so as to distribute more luminous element groups 610 uniformly on different areas of the driver circuit board 400, thereby making the outgoing light more uniform. Because increasing the number of the luminous element groups 610 can lower the current flowing through the second luminous elements 612, the heat generated by each second luminous elements 612 can be lowered, thereby preventing the light emitted by the second luminous element 612 from degrading owning to overheat.

Figure 3:
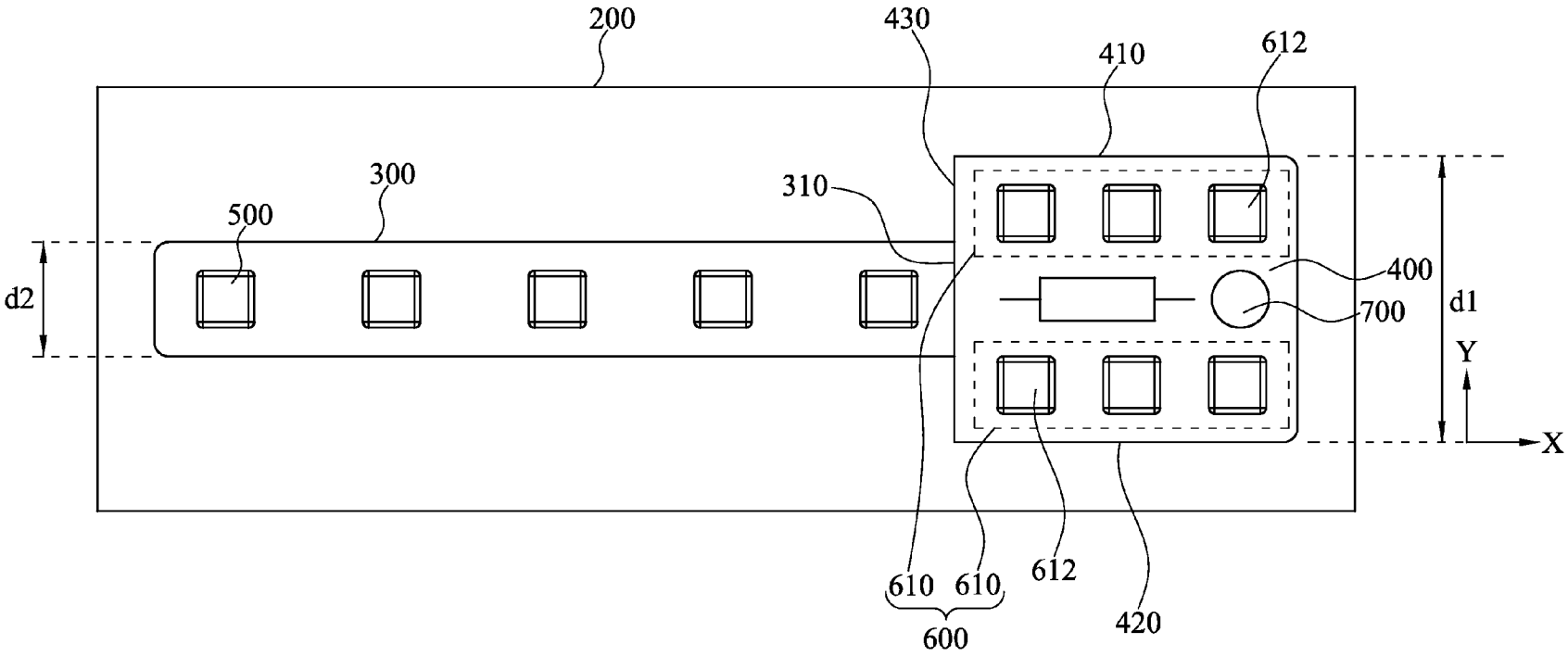
FIG. 3 is a top view of the carrier and the elements thereon in FIG. 1.

FIG. 3 is a top view of the carrier 200 and the elements thereon in FIG. 1. As shown in FIG. 3, in some embodiments, the luminous element groups 610 are arranged on the driver circuit board 400 side by side.

In some embodiments, the second luminous elements 612 in each luminous element group 610 are arranged substantially along the lengthwise direction of the driver circuit board 400, such as the "X" direction in FIG. 3, so as to emit light along the lengthwise direction of the driver circuit board 400. In other words, numerous second luminous elements 612 of a single luminous element group 610 can be arranged as a row, and numerous luminous element groups 610 can arranged substantially along the widthwise direction of the driver circuit board 400, such as the "Y" direction in FIG. 3, so as to uniformly emit light on various areas of the driver circuit board 400. It is noted that the lengthwise direction of the driver circuit board 400 is parallel to the lengthwise direction of the light bar circuit board 300.

In some embodiments, the lamp further includes at least one driving element 700 disposed on the driver circuit board 400 and between two of the luminous element groups 610. In other words, two luminous element groups 610 are disposed on opposite sides of the driving element 700. Because numerous second luminous elements 612 can be disposed on the driver circuit board 400, even though the height of the driving element 700 is higher than the height of each of the second luminous elements 612, it cannot shade all of the second luminous elements 612, thereby further preventing the dark area occurs. In some embodiments, the driving element 700 includes, but is not limited to include, an AC to DC converter. This converter may include a driving IC and numerous passive elements. The driving IC can increase or decrease the current outputted to the luminous element based on the current detected from the luminous element. The passive element may include, but is not limited to include, a resistor, an inductor or a capacitor. In some embodiments, the position of the second luminous element 612 on the driver circuit board 400 can be moved corresponding to the position of the driving element 700.

In some embodiments, the driver circuit board 400 includes a width d1, and the light bar circuit board 300 includes a width d2. The width d1 is greater than the width d2. Because the width d1 of the driver circuit board 400 is greater, the luminous element groups 610 are more easily to be arranged along the widthwise direction of the driver circuit board 400, such as the "Y" direction in FIG. 3. Moreover, lengthening the width d1 can increase space to put the driving element 700.

As shown in FIG. 3, two luminous element groups 610 can respectively be close to opposite edges of the driver circuit board 400. Specifically, one of the luminous element groups 610 is close to the top edge 410 of the driver circuit board 400, and another is close to the bottom edge 420 of the driver circuit board 400.

The inner edge 430 of the driver circuit board 400 adjoins the inner edge 310 of the light bar circuit board 300. The inner edge 430 of the driver circuit board 400 and the inner edge 310 of the light bar circuit board 300 can be fastened by welding. Alternatively, the inner edge 430 of the driver circuit board 400 and the inner edge 310 of the light bar circuit board 300 can be fastened by male and female joints (not shown).

In some embodiments, the lamp includes a reflective material coated on the area of the driver circuit board 400 around the luminous element groups 610. The reflective material can be, but is not limited to be, white coating material, so as to reflect the light emitted by the second luminous element 612.

Figure 4:
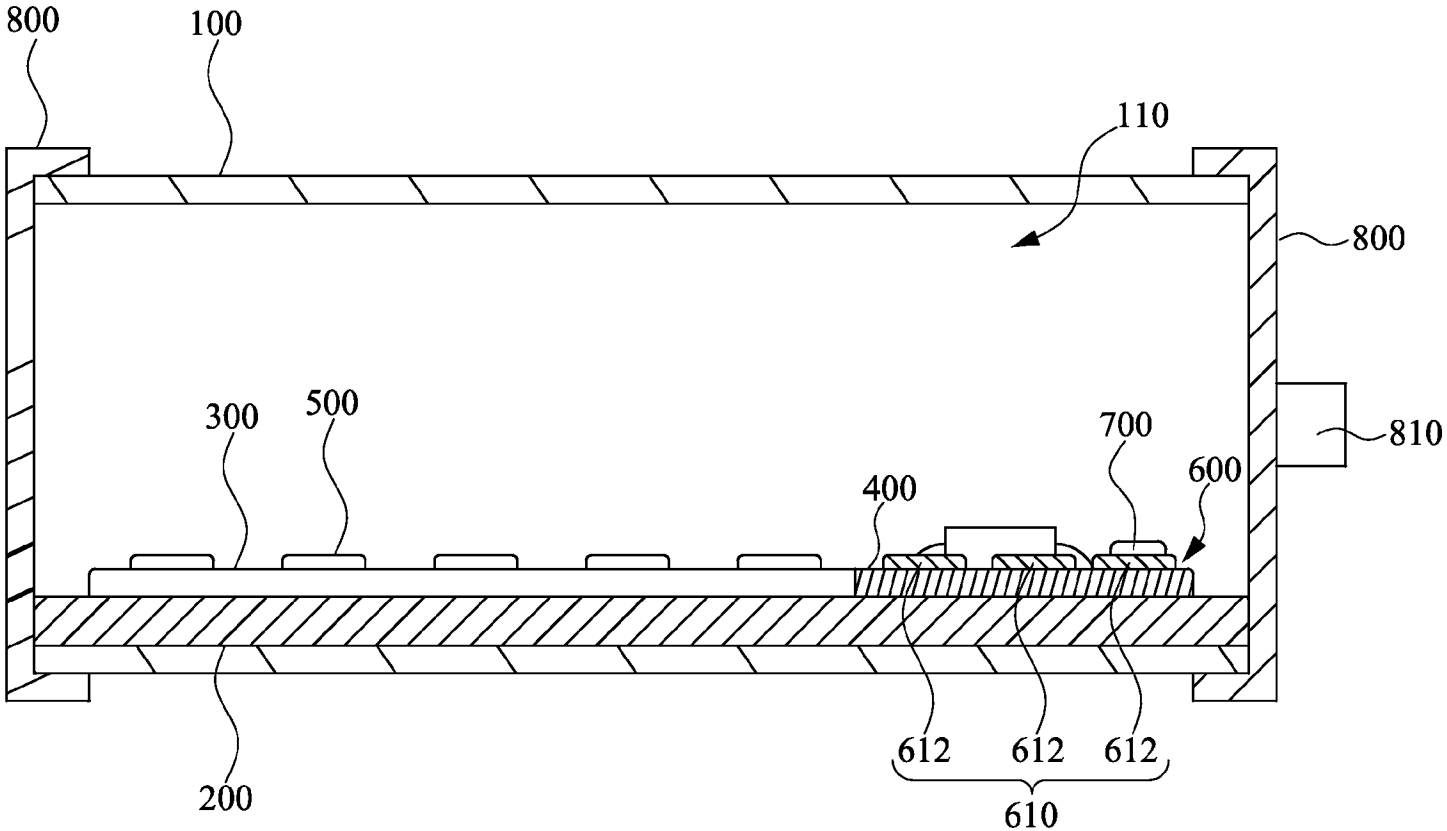
FIG. 4 is a cross sectional view of the assembled lamp along A-A' line in FIG. 1.

FIG. 4 is a cross sectional view of the assembled lamp along A-A' line in FIG. 1. As shown in FIG. 4, in some embodiments, the lamp further includes a pair of end caps 800 respectively covering opposite ends of the lamp tube 100. Specifically, a lamp chamber 110 is formed in the lamp tube 100, and it can be used to accommodate the carrier 200, the light bar circuit board 300, the driver circuit board 400, the first luminous elements 500, the parallel-connected type luminous unit 600 and the driving element 700. The end caps 800 respectively cover opposite ends of the lamp tube 100, so as to seal the lamp chamber 110. The joint between the end cap 800 and the lamp tube 100 is watertight or airtight, so as to prevent external objects, such as dusts or water, from getting into the lamp chamber 110 and influencing the work of the first luminous elements 500 and the parallel-connected type luminous unit 600. The shape of the inner surface of the end cap 800 matches the shape of the end of the lamp tube 100, so that the end cap 800 and the lamp tube 100 can be assembled tightly.

As shown in FIG. 4, the end cap 800 closer to the driver circuit board 400 includes a connection pin 810, which receives external power and transmits the power to the driver circuit board 400. The carrier 200 can be a rigid structure, such as a heat dissipation carrier formed by metal, or an aluminum extrusion structure, so as to prevent the lamp tube 100 from bending and to dissipate heat from the light bar circuit board 300 and the driver circuit board 400.

In some embodiments, the first luminous element 500 is a LED. Specifically, the first luminous element 500 can be, but is not limited to be, a LED package or a LED chip. In some embodiments, the second luminous element 612 is a LED. Specifically, the second luminous element 612 can be, but is not limited to be, a LED package or a LED chip.

It is noted that the description "the feature A is disposed on the feature B" in this specification not only refers to the embodiment that the feature A directly contacts the feature B, but also refers to the embodiment that an additional feature C is disposed between the feature A and the feature B. For example, "the first luminous elements 500 are disposed on the light bar circuit board 300" not only includes the embodiment that the first luminous elements 500 are in direct contact with the light bar circuit board 300, but also includes the embodiment that an additional element, such as heat dissipation glue or heat dissipation element, is intervened between the first luminous elements 500 and the light bar circuit board 300.

It is noted that the term "substantially" in this specification that any minor variation or modification not affecting the essence of the technical feature can be included in the scope of the present invention. For example, "the second luminous elements 612 of the luminous element group 610 are arranged substantially along the lengthwise direction of the driver circuit board 400" not only includes the embodiment that the second luminous elements 612 are arranged exactly along the lengthwise direction of the driver circuit board 400, but also includes the embodiment that some second luminous elements 612 are slightly deviated from the lengthwise direction of the driver circuit board 400.

Although the present invention has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims.

What is claimed is:

1. A lamp, comprising:

a lamp tube having a lamp chamber therein;

at least one end cap covering an end of the lamp tube;

a carrier accommodated in the lamp chamber of the lamp tube;

a light bar circuit board disposed on a portion surface of the carrier and accommodated in the lamp chamber;

a driver circuit board disposed on the other portion surface of the carrier and physically adjoining the light bar circuit board, the driver circuit board being accommodated in the lamp chamber and adjacent to the end cap;

a plurality of first luminous elements disposed on the light bar circuit board to emit light through the lamp tube; and a plurality of second luminous element groups, each second luminous element group connected in parallel and disposed on the driver circuit board in the lamp chamber, to emit light through the lamp tube; and at least one driving element disposed on the driver circuit board and between two of the second luminous element groups from the plurality of second luminous element groups.

2. The lamp of claim 1, wherein the first luminous elements are connected to the second luminous element groups in series.

3. The lamp of claim 1, wherein the carrier is a heat dissipation carrier formed by metal.

4. The lamp of claim 1, wherein each of the second luminous element groups comprises a plurality of second luminous elements, and the second luminous elements are arranged substantially along the lengthwise direction of the driver circuit board.

5. The lamp of claim 4, wherein the second luminous elements are connected in series.

6. The lamp of claim 4, wherein the second luminous element is a light emitting diode (LED).

7. The lamp of claim 1, wherein the width of the driver circuit board is greater than the width of the light bar circuit board.

8. The lamp of claim 1, further comprising a reflective material coated on the area of the driver circuit board around the second luminous element groups.

9. The lamp of claim 1, wherein a pair of the end caps respectively cover opposite two of the ends of the lamp tube.

10. The lamp of claim 1, wherein the first luminous element is a LED.

* * * * *